United States Patent [19]

Ross

[11] 4,184,704

[45] Jan. 22, 1980

[54] ACCESS DOOR LOCK SYSTEM

[75] Inventor: Frank E. Ross, Newton, Iowa

[73] Assignee: The Maytag Company, Newton, Iowa

[21] Appl. No.: 860,436

[22] Filed: Dec. 14, 1977

[51] Int. Cl.[2] ..... E05C 3/10; E05C 13/10

[52] U.S. Cl. ..... 292/201

[58] Field of Search ..... 292/201, DIG. 69, DIG. 71, 292/144

[56] References Cited

U.S. PATENT DOCUMENTS

| | | | |
|---|---|---|---|
| 2,910,317 | 10/1959 | Conlee | 292/144 |
| 3,243,977 | 4/1966 | Norgaard | 292/128 |
| 3,272,935 | 9/1966 | Beller et al. | 292/201 |
| 3,387,873 | 6/1968 | Prosser et al. | 70/172 |
| 3,602,662 | 8/1971 | Haller | 200/61.76 |
| 3,716,122 | 2/1973 | Baker et al. | 200/61.45 R |
| 4,056,276 | 11/1977 | Jarvis | 292/201 |

*Primary Examiner*—Richard E. Moore

*Attorney, Agent, or Firm*—Richard L. Ward

[57] ABSTRACT

An access door lock system for an automatic washing machine which includes a timer having an internal manually operated On-Off switch, a latch biased to normally engage with and lock the access door, and a latch actuating mechanism interconnecting the timer and the latch and preventing opening of the access door when the timer-associated switch is in the On condition. After the switch is moved to the Off condition, the latch actuating mechanism is operable to a position for disengaging the latch from the access door and allowing the access door to be opened.

12 Claims, 6 Drawing Figures

ACCESS DOOR LOCK SYSTEM

BACKGROUND OF THE INVENTION

1. Field of the Invention

This invention relates to an access door lock system and more particularly to an access door lock system for an automatic washing machine to provide for locking the access door during periods of machine operation.

2. Description of the Prior Art

The prior art shows a continuing search for ways to prevent access to the tube portion of an automatic washing machine during its cycle of operations and particularly during the extraction period of the cycle.

Norgaard, in U.S. Pat. No. 3,243,977, uses a solenoid which is operable for blocking the door latch to prevent opening of the door whenever electrical power is applied to the machine.

Prosser et al, in U.S. Pat. No. 3,387,873, utilizes a timer cam to move a follower member into position to block movement of the door handle and thus prevent opening in the door during operation of the machine.

Haller, in U.S. Pat. No. 3,602,662, manually actuates the machine by a separate member on the door which is operable only after the access door is closed.

Baker et al, in U.S. Pat. No. 3,716,122 shows a mechanical linkage which is movable by axially moving the timer shaft. This linkage operates to lock the lid of the machine. This system is also associated with the tub such that an unbalance situation will open a line switch within the timer.

While several methods are shown for preventing access to the interior of the machine during a cycle of operations, the prior art does not show a system which is dependent upon a combination of manual operations to open the access door but which is fully automatic for locking the access door.

SUMMARY OF THE INVENTION

It is therefore an object of the instant invention to provide an improved access door lock system for an automatic washing machine.

It is a further object of the instant invention to provide an access door lock system which permits opening of the access door only when the timer switch is in the Off condition and the latch actuator has been manually rotated into engagement with the latch.

Briefly, the instant invention achieves these objects in an access door lock system for an apparatus having a cabinet with an access door movable between an open and a closed position. A strike is mounted on either of the cabinet or the access door and a latch is mounted on the other of the cabinet or access door with the latch being normally engaged with the strike to lock the access door in the closed position. A latch actuator is provided which has a portion movable from a door-locked first posture to a door-unlocked second posture for disengaging the latch from the strike to permit opening of the access door. A manually operable mechanism is provided for making and breaking an electrical circuit and includes a switch operable between an apparatus-deenergizing first condition and an apparatus-energizing second condition. A connecting lever interconnects the latch actuator and the circuit making and breaking mechanism and is operable for blocking movement of the latch actuator from its door-locked first posture when the switch is in the apparatus-energizing second condition. The access door can be opened only when the switch is in the apparatus-deenergizing first condition and the latch has been disengaged from the strike.

Operation of the system and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views wherein.

DESCRIPTION OF THE PREFERRED EMBODIMENT

Figure 1:
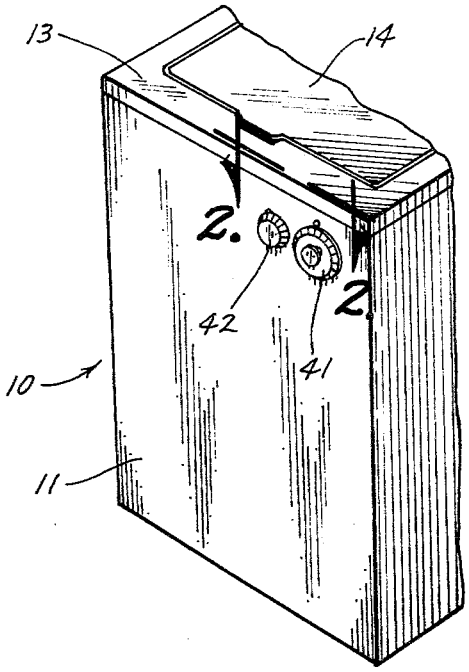
FIG. 1 is a partial perspective view of an automatic washing machine showing the cabinet top, access door, and control dials.
Figure 2:
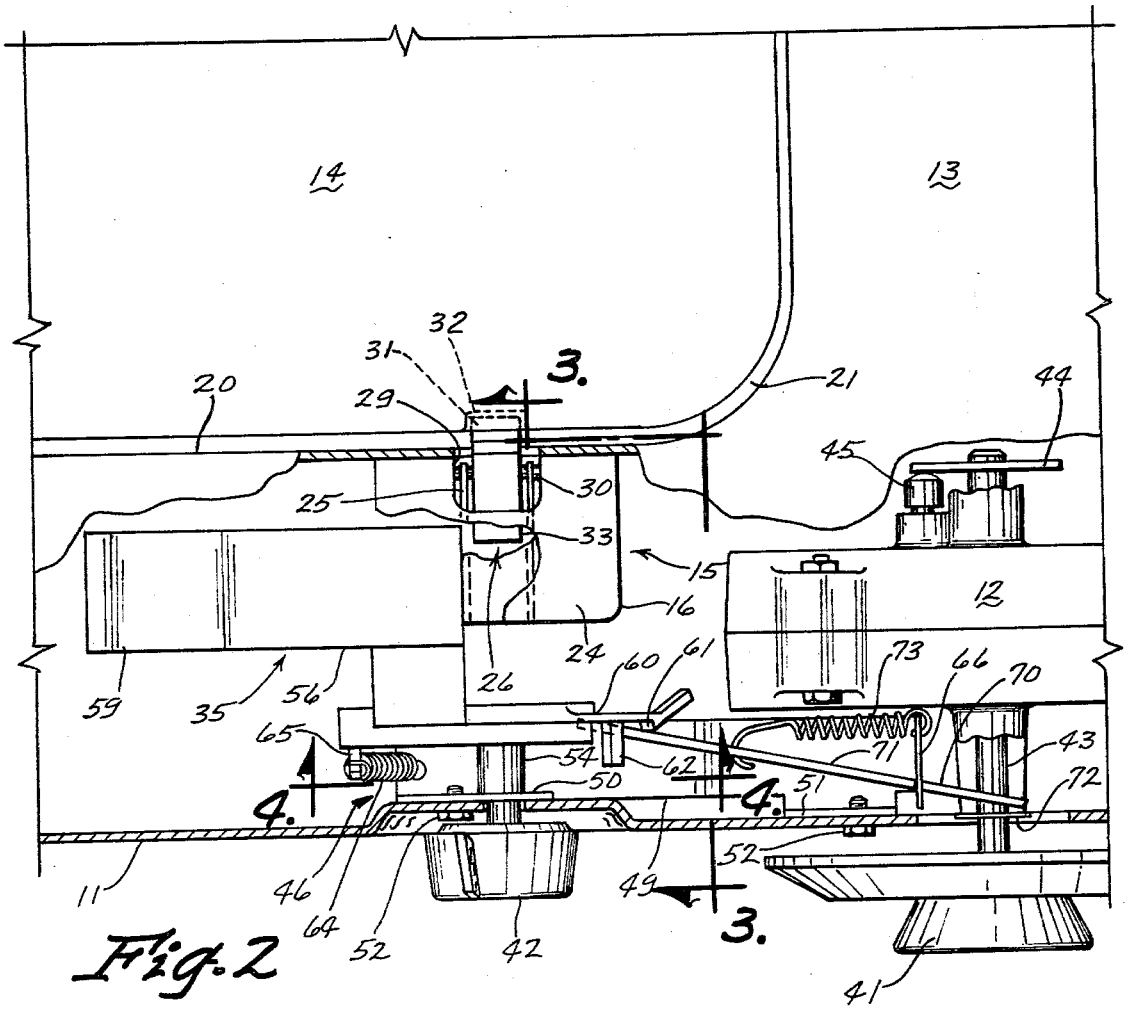
FIG. 2 is a view taken generally along lines 2—2 of FIG. 1.

Referring now to the drawings there is shown in FIG. 1 a perspective view of an automatic wasing machine 10 including a cabinet 11 which houses a timer 12, as shown in FIG. 2, and supports a top cover 13 having an access door or lid 14. The automatic washing machine 10 further includes various mechanical components such as: drive motor, pump, transmission, tub and agitator. These members are well known to those skilled in the art and are therefore not shown.

Figure 3:
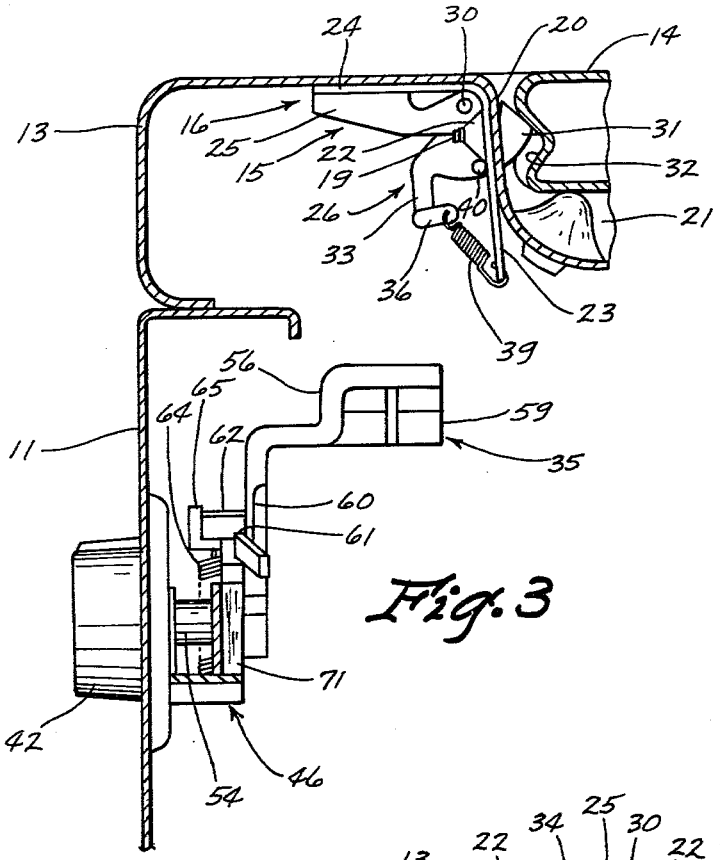
FIG. 3 is a view taken generally along lines 3—3 of FIG. 2.
Figure 4:
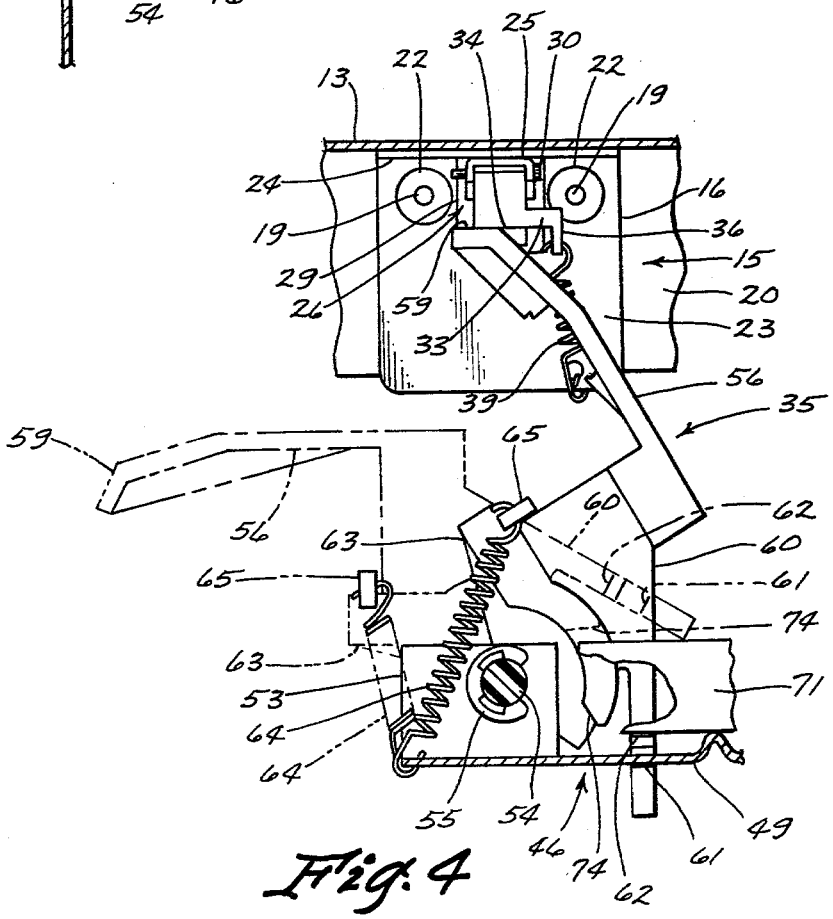
FIG. 4 is a view taken generally along lines 4—4 of FIG. 2.

Referring to FIGS. 2, 3 and 4 there is shown a latch assembly 15 including a generally right angled latch mounting bracket 16 which is secured to the underside of the top cover 13, as shown in FIG. 3, by a pair of threaded fasteners 19 which extend through the substantially vertical wall 20 of the access opening 21 and are turned into threaded holes in the extruded dimples 22 of the generally vertical leg 23 of the latch mounting bracket 16. The horizontal leg 24 of the latch mounting bracket 16 extends to the left in FIG. 3 directly subjacent the top cover 13 and has a "U" shaped channel member 25 secured to its bottom as shown in FIG. 4. The "U" of this channel member 25 opens downwardly as in FIGS. 3 and 4 and a pair of axially aligned holes are punched in the opposed sidewalls of the "U" for pivotally mounting a latch 26. The generally vertical leg 23 of the latch mounting bracket 16 further includes a rectangular opening 29 in its center which is juxtaposed to and generally aligned with a similar opening in the substantially vertical wall 20 of the access opening 21 for accommodating the latch 26.

The latch 26 is molded of a thermoplastic material and is pivotally mounted between the sidewalls of the "U" shaped channel member 25 on a pivot pin 30 which extends through the axially aligned holes and the latch 26. As shown in FIG. 3, a bolt portion 31 of the latch 26 extends through the rectangular opening 29 in the latch mounting bracket 16 and the vertical wall 20 of the access opening 21 to engage with a depression or strike 32 in the edge of the access door 14. Extending downwardly in FIG. 3 is a depending arm portion 33 of the latch 26. This depending arm portion 33 includes a flat surface 34, shown in FIG. 4, for engaging with a latch actuator 35. The depending arm portion 33 also includes a tab 36 for securing one end of an extension spring 39 which extends toward the lower portion of the generally vertical leg 23 of the latch mounting bracket 16 and normally biases the bolt 31 of the latch 26 toward the depression or strike 32 in the edge of the access door 14 for locking the door 14 closed. The extent of the latch 26 movement toward the access door 14 is limited by a round peg 40 which is molded onto the side of the latch 26 and which contacts the generally vertical leg 23 of the latch mounting bracket 16 as shown in FIG. 3.

Figure 5:
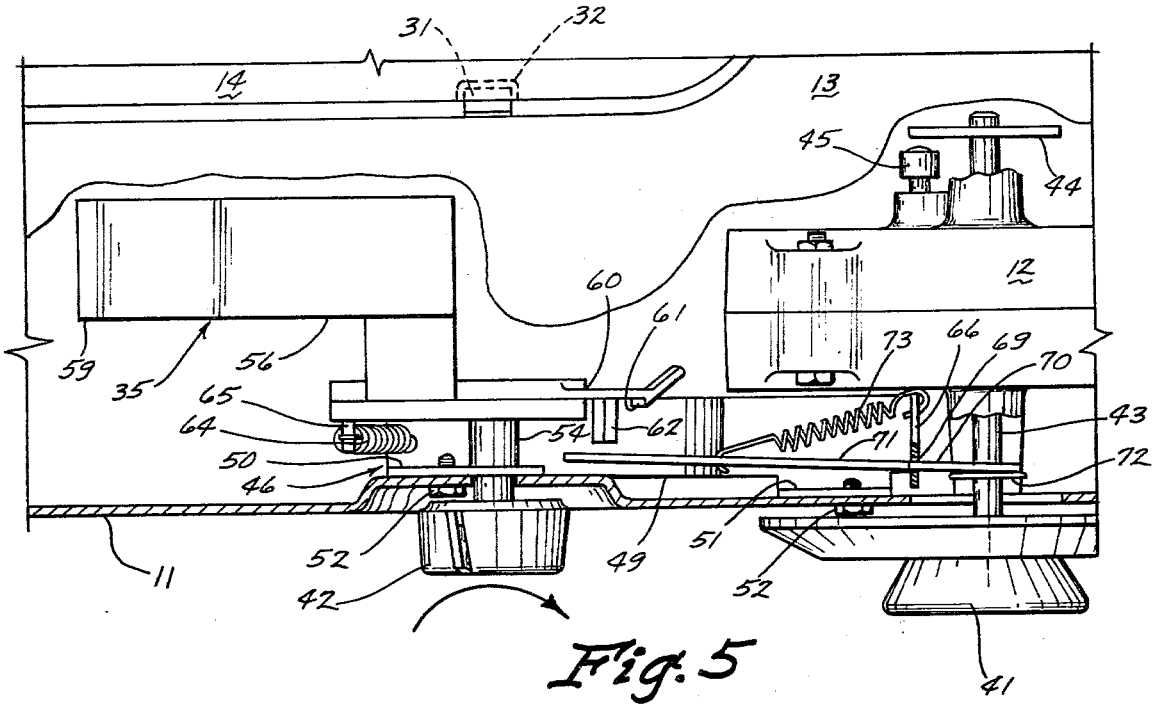
FIG. 5 is a view similar to FIG. 2 showing the timer dial in the Off position and the corresponding position of the connecting lever.

Referring generally now to FIGS. 1, 2 and 5 there are shown two control dials 41 and 42. The first and largest of these dials is the timer dial 41 secured to the shaft 43 of the timer or sequential control means 12 and which is manually rotatable to select a start point for a cycle of operations. The timer 12 includes an internal On-Off switch which, as shown in FIGS. 2 and 5, is actuated by a disc 44 attached to the rearwardly extending portion of the timer shaft 43 and which is engageable with a plunger 45 of the rear of the timer 12 to close the internal On-Off switch and begin a cycle of operations as the timer dial 41 is pulled out away from the washing machine 10. The cycle of operations may be interrupted at any point by pushing the timer dial 41 inward to release the plunger 45 and open the internal On-Off switch.

FIGS. 2 and 5 best show the latch actuator mounting plate 46. As viewed in either of FIG. 2 or 5, the main portion 49 of this mounting plate 46 is generally horizontal and is secured to the inside of the cabinet 11 directly behind the first and second control dials 41 and 42. This mounting plate 46 has an upturned attachment ear 50 and 51 at each end adjacent the inside of the cabinet and each ear 50 or 51 is tapped for receiving a threaded fastener 52 to secure the mounting plate 46 to the cabinet.

FIG. 4 is a section through the left end of the latch actuator mounting plate 46 and in particular shows an upwardly turned tab 53 which is generally aligned with and to the rear of the left attachment ear 50. This tab 52 has an aperture which is axially aligned with a similar aperture in the left attachment ear 50. These axially aligned apertures rotatably mount the shaft 54 of a latch actuator 35 to the latch actuator mounting plate 46. The latch actuator shaft 54 is axially retained by a snap ring 55 as shown in FIG. 4.

The latch actuator 35, in the preferred embodiment, is molded of a thermoplastic material and includes a first arm 56 extending to the left as shown in phantom in FIG. 4. This first arm 56 includes a downwardly sloped end section or cam surface 59 for engaging with the flat surface 34 of the latch 26 to move the latch 26 out of engagement with the depression or strike 32 in the access door 14 as shown in the full line portion of FIG. 4. Extending downwardly and to the right as best shown in phantom in FIG. 4 is a second arm portion 60. As FIGS. 2 through 5 show, the second arm portion 60 includes a catch 61 and a lug 62. The catch 61 engages with the underside of the mounting plate 46 as shown in the full line portion of FIG. 4 for maintaining the latch actuator 35 in the full line position. The lug 62 engages with the top of the mounting plate 46 as shown in the full line position of FIG. 4 to limit the clockwise rotation of the latch actuator 35.

The latch actuator 35 is normally biased in the counterclockwise direction toward the phantom line position by an extension spring 64 which is hooked between the left end of the mounting plate 46 and an attachment ear 65 on the latch actuator 35. Counterclockwise rotation of the latch actuator 35 from the full line position to the phantom line position of FIG. 4 is limited by engagement of a wall section 63 of the latch actuator 35 with the upturned tab 53 of the mounting plate 46 as shown in FIG. 4.

At the right end of the latch mounting plate 46 and at generally 90 degrees to the attachment ear 51 there is located an upturned connecting lever mounting tab 66. As shown in FIG. 5, this tab 66 has a vertical slot 69 for receiving the narrowed end 70 of a connecting lever 71. This rectangularly shaped connecting lever 71 operatively joins the timer shaft 43 and the latch actuator 35. The timer end 70 of the connecting lever 71 is vertically narrowed for passing through the vertical slot 69 in the mounting tab 66. The narrowed portion 70 at the timer end is also bifurcated so that it will engage with the timer shaft as shown in FIGS. 2 and 5. As best shown in FIGS. 2 and 5 a snap ring 72 is secured to the timer shaft 43. This snap ring 72 engages with the narrowed bifurcated end 70 of the connecting lever 71 so that when the timer dial 41 is pushed inward the connecting lever 71 will be pivoted to the position of FIG. 5.

An extension spring 73 is stretched between the connecting lever mounting tab 66 and the mid-section of the connecting lever 71 for biasing the narrowed timer end 70 of the connecting lever 71 axially toward the connecting lever mounting tab 66 and timer shaft 43. The latch actuator end of the connecting lever 71 is concurrently biased transversely toward the latch actuator 35.

The latch actuator end of the connecting lever 71 is operable for two different functions. First, when the latch actuator 35 is in the position of FIG. 2, which corresponds to the phantom line position of FIG. 4, and the On-Off switch is in the On condition, the end of the connecting lever 71 engages with the abutment 74 of the latch actuator 35 and prevents clockwise rotation of the latch actuator 35 to the access door unlocking full line position of FIG. 4. Secondly, when the latch actuator 35 is in the full line position of FIG. 4 and the On-Off switch is moved from the Off condition to the On condition by pulling the timer dial 41 outward, the connecting lever 71 will be biased toward the latch actuator 35 by the extension spring 73 and will contact the front end of lug 62 of the latch actuator 35 which will deflect arm 60 to disengage the catch 61 from the underside of the mounting plate 46 and the latch actuator 35 will be rotated by the extension spring 64 out of engagement with latch 26 as in FIG. 2 which corresponds to the phantom lines in FIG. 4 for locking the door 14. When the latch actuator 35 is in the latch engaged, door-unlocked full line position in FIG. 4, the timer 12 will be in the Off condition as shown in FIG. 5 and the connecting lever 71 will be disconnected from the latch actuator 35.

Figure 6:
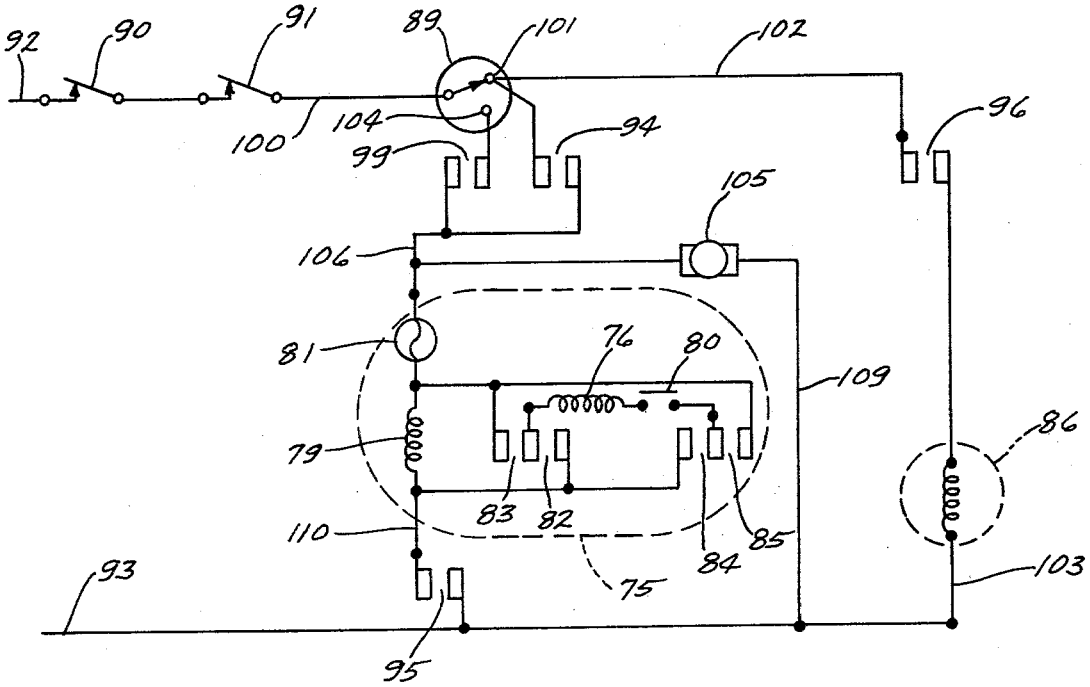
FIG. 6 is a schematic electrical circuit showing operational and control components of the washing machine of FIG. 1.

There is shown in FIG. 6 an electrical schematic circuit. The circuit of FIG. 6 includes a plurality of contact pairs operable between open and closed positions by a set of cams under the control of a timing motor. The contact pairs function as switching means and are referred to as timer switches which open and close under control of the timer cams.

The circuit of FIG. 6 also includes the drive motor 75 comprising a start winding 76, a run winding 79, centrifugal switch 80 and fuse 81. Timer switches 82-85 as shown in FIG. 6 control functions of the drive motor 75 but are not physically associated with the drive motor 75. Also shown diagrammatically in FIG. 6 is the water valve 86, a pressure switch 89, an access door operated switch 90 and an On-Off switch 91 located within the timer 12 to initiate operation such as may be operated to the closed position by the operator axially moving the timer dial 41. The circuit may be connected to a conventional 110 volt, 60 Hz. power supply by the line conductors 92 and 93.

The normal washing cycle of operations of an automatic washing machine 10 includes, in sequence, an initial liquid filling of the machine 10, agitation to effect washing of the fabrics; removal of the washing fluid; a refilling of the machine 10 with rinse water; agitation to effect rinsing of the fabrics; and removal of the rinse water from the machine 10.

The "Regular" cycle of operations is selected by rotating the timer dial 41 to the start position. With the selection of the "Regular" cycle of operations, timer switches 83, 84, 95, 96 and 99 will be closed. Upon the operator closing the On-Off switch 91, as by axially moving the timer dial 41 and assuming that the access door switch 90 has been closed by closing the lid or access door 14, the machine 10 will be energized for initiating the "Regular" cycle of operations.

A circuit is completed through line conductor 92, the access door switch 90, the On-Off switch 91, conductor 100, the pressure switch 89 made to the "empty" contact 101, through conductor 102, and closed timer switch 96 to the water valve 86. The other side of the water valve 86 is connected to line conductor 93 through conductor 103. The water valve 86 will operate until the pressure switch 89 operates from the "empty" contact 101 to the "full" contact 104. When the pressure switch 89 moves to the "full" contact 104 a circuit is completed to the timer motor 105 through timer switch 99, and conductor 106 for energizing the timer motor 105. The other side of the timer motor 105 is connected to line conductor 93 by conductor 109.

The drive motor 75 will be energized to initiate agitation of the fluid and the fabrics within the tub. The drive motor 75 circuit extends from line conductor 92, through the access door switch 90, the On-Off switch 91, the pressure switch 89 made to "full" contact 104, the timer switch 99 and through conductor 106 to one side of the drive motor 75. The other side of the motor 75 is connected through conductor 110 and the timer motor interrupter switch 95 to line conductor 93. The apparatus will proceed through the "Regular" cycle of operations comprising washing and rinsing functions under control of the timer or sequence control mechanism 12.

As mentioned in the explanation of the circuit of FIG. 6, the automatic washing machine 10 is either energized or deenergized depending on the axial position of the timer shaft 43. FIGS. 2 and 3 show the relative positions of the latch 26, the latch actuator 35, and the connecting lever 71 when the timer dial 41 is pulled out so that the internal On-Off switch 91 is closed and the washing machine 10 is energized. The latch bolt 31 is normally biased into engagement with the depression or strike 32 of the access door or lid 14.

FIGS. 4 and 5 show the general relationship of these same components when the timer dial 41 is pushed in to move the internal On-Off switch 91 to the Off condition. As shown in FIG. 5, the connecting lever 71 has been pivoted with respect to the mounting plate 46 so that it will not be in interference with the latch actuator 35. With the connecting lever 71 in this non-interferring position the operator can manually rotate the second dial 42 clockwise to move the latch actuator 35 into the full line position of FIG. 4. The cam surface 59 of the first arm 56 of the latch actuator 35 contacts the flat surface 34 of the depending arm portion 33 of the latch 26 and will overcome the extension spring 39 to pivot the bolt portion 31 of the latch 26 out of engagement with the depression or strike 32 of the access door 14 which will allow the access door 14 to be opened to load or unload the washing machine 10.

Moving the control of the washing machine 10 to the Off position requires only the action of pushing the timer dial 41 inward to open the internal On-Off switch 91. A time delay between turning the machine 10 Off and opening the access door 14 is obtained since the second dial 42 must be manually rotated in a clockwise direction to engage the latch actuator 35 with the latch 26 for movement of the bolt portion 31 of the latch 26 out of engagement with the depression or strike 32 of the access door 14. This time delay allows the spinning tub to increase speed by coasting and reduces the change of the operator coming in contact with a rapidly rotating tub.

It is therefore seen that the instant invention provides a unique access door lock system for an automatic washing machine 10 which will automatically lock the access door 14 when the washing machine 10 is energized but which can be readily manually disengaged when the washing machine 10 is deenergized.

In the drawings and specification there has been set forth a preferred embodiment of the invention and although specific terms are employed these are used in a generic and descriptive sense only and not for purposes of limitation. Changes in form and proportion of parts, as well as the substitution of equivalents are contemplated, as circumstances may suggest or render expedient, without departing from the spirit or scope of this invention as defined in the following claims.

I claim:

1. An access door lock system for an apparatus including cabinet means having an access door movable between an open position and a closed position, the combination comprising: strike means on one of said access door and cabinet means; latch means on the other of said access door and cabinet means and being normally engageable with said strike means for locking said access door in said closed position; latch actuating means including a portion movable from a door-locked first posture to a door-unlocked second posture for effecting disengagement of said latch means from said strike means to permit opening of said access door; manually operable means for making and breaking an electrical circuit including switch means operable between an apparatus-deenergizing first condition and an apparatus-energizing second condition; and connecting means mechanically interconnecting said latch actuating means with said circuit making and breaking means and operable for blocking movement of said latch actuating means from said door-locked first posture when said switch means is in said apparatus-energizing second condition, whereby said access door may be opened only when said switch means is in said apparatus-deenergizing first condition and said latch actuating means has been moved to said door-unlocked second posture.

2. An access door lock system as defined in claim 1 wherein said latch means is biased toward said strike means for engagement therewith.

3. An access door lock system as defined in claim 1 wherein said connecting means includes a lever engageable with said latch actuating means when said latch actuating means is in said door locked first posture and said switch means is in said apparatus-energizing second posture to block movement of said latch actuating means and wherein said lever is operable to a non-blocking position responsive to movement of said switch means to said apparatus-deenergizing first condition for allowing said latch actuating means to be moved from said door-locked first posture to said door-unlocked second posture.

4. An access door lock system as defined in claim 1 wherein said latch actuating means further includes biasing means for automatically returning said latch actuating means to said door-locked first posture when said switch means is moved to said apparatus-energizing second condition.

5. An access door lock system for an apparatus including cabinet means having an access door movable between an open position and a closed position, the combination comprising: strike means on one of said access door and cabinet means; latch means on the other of said access door and cabinet means and being normally engageable with said strike means for locking said access door in said closed position; latch actuating means including a portion movable from a door-locked first posture to a door-unlocked second posture for effecting disengagement of said latch means from said strike means to permit opening of said access door; means for making and breaking an electrical conduit including switch means operable between an apparatus-deenergizing first condition and an apparatus-energizing second condition and further including operating means for manually operating said switch means between said first and second conditions and for initiating movement of said latch actuating means between said first and second postures; and connecting means mechanically interconnecting said latch actuating means with said switch means and operable for blocking movement of said latch actuating means from said door-locked first posture when said switch means is in said apparatus-energizing second condition, said connecting means being operable to a non-blocking position whereby said access door may be opened only when said switch means is in said apparatus-deenergizing first condition and said latch actuating means has been moved to said door-unlocked second posture.

6. An access door lock system as defined in claim 5 wherein said latch actuating means includes first and second arms with said first arm being movable by said operating means from said door-locked first posture to said door-unlocked second posture for engaging with and disengaging said latch means from said strike means, said second arm being concurrently movable with said first arm and including a catch operable for maintaining said first arm in engagement with said latch means.

7. An access door lock system as defined in claim 5 which further includes timer means associated with said switch means having a manually rotatable and axially movable shaft wherein said switch means is operable between said first and second conditions by axial movement of said shaft.

8. An access door lock system as defined in claim 7 wherein said connecting means extends between said shaft and said latch actuating means and is responsive to said axial movement of said shaft for engaging with said actuating means.

9. An access door lock system for a washing machine including cabinet means having an access door movable between an open position and a closed position, the combination comprising: strike means on said access door; latch means on said cabinet means normally biased toward said strike means for engagement therewith and for locking said access door in said closed position; latch actuating means including a first arm movable from a door-locked first posture to a door-unlocked second posture for effecting disengagement of said latch means from said strike means to permit opening of said access door, said latch actuating means further including a second arm operable concurrently with said first arm and having a catch operable for maintaining said first arm in engagement with said latch means; timer means including switch means manually operable between an apparatus-deenergizing first condition and an apparatus-energizing second condition; and connecting means connecting said latch actuating means with said timer associated switch means and operable for blocking movement of said latch actuating means from said door-locked first posture when said switch means is in said apparatus-energizing second condition, whereby said access door may be opened only when said switch means is in said apparatus-deenergizing first condition and said latch actuating means has been moved to said latch disengaged second posture.

10. An access door lock system as defined in claim 9 wherein said latch actuating means is biased toward said door-locked first posture and said connecting means is biased for blocking movement of said latch actuating means such that when said switch means is in said apparatus-energizing second condition said latch means will be automatically returned to engagement with said strike means.

11. An access door lock system as defined in claim 9 which further includes operating means for manually operating said switch means between said first and second conditions and for moving said latch actuating means between said first and second postures.

12. An access door lock system as defined in claim 11 wherein said connecting means is operable to a non-blocking position responsive to movement by said operating means of said switch means to said apparatus-deenergizing first condition.

* * * * *

UNITED STATES PATENT AND TRADEMARK OFFICE

CERTIFICATE OF CORRECTION

PATENT NO. : 4,184,704

DATED : January 22, 1980

INVENTOR(S) : Frank E. Ross

It is certified that error appears in the above-identified patent and that said Letters Patent are hereby corrected as shown below:

| Pat. Ref. | Error |
|---|---|
| Col. 1, line 12 | "tube" should be -- tub -- |
| Col. 1, line 22 | "in" should be -- of -- |
| Col. 3, line 25 | "of" (first occurrence) should be -- on -- |
| Col. 3, line 44 | "52" should be -- 53 -- |
| Col. 6, line 26 | "increase" should be -- decrease -- |
| Col. 6, line 27 | "change" should be -- chance -- |
| Col. 7, line 36 | "conduit" should be -- circuit -- |

Signed and Sealed this

*Twenty-second* Day of *April 1980*

[SEAL]

*Attest:*

SIDNEY A. DIAMOND

*Attesting Officer*

*Commissioner of Patents and Trademarks*